US008858760B2

(12) United States Patent
Kida et al.

(10) Patent No.: US 8,858,760 B2
(45) **Date of Patent: *Oct. 14, 2014**

(54) LOW IGNITION PROPENSITY WRAPPING PAPER MANUFACTURING MACHINE

(71) Applicant: Japan Tobacco Inc., Tokyo (JP)

(72) Inventors: Shinzo Kida, Tokyo (JP); Keisuke Towatari, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/829,746

(22) Filed: Mar. 14, 2013

(65) Prior Publication Data

US 2013/0247927 A1 Sep. 26, 2013

Related U.S. Application Data

(63) Continuation of application No. PCT/JP2011/069181, filed on Aug. 25, 2011.

(30) Foreign Application Priority Data

Sep. 29, 2010 (JP) ..... PCT/JP2010/066926

(51) Int. Cl.
*D21F 1/00* (2006.01)

(52) U.S. Cl.
USPC ..... 162/232

(58) Field of Classification Search
USPC ..... 162/232, 139; 131/365, 264; 427/199, 427/384; 428/211.1; 118/68
See application file for complete search history.

(56) References Cited

U.S. PATENT DOCUMENTS

| | | | | |
|---|---|---|---|---|
| 6,929,013 | B2 * | 8/2005 | Ashcraft et al. | 131/365 |
| 8,241,460 | B2 * | 8/2012 | Kida et al. | 162/139 |
| 8,568,896 | B2 * | 10/2013 | Kida et al. | 428/532 |
| 2010/0116282 | A1 | 5/2010 | Kominami | |
| 2010/0297351 | A1 | 11/2010 | Kida et al. | |
| 2012/0090799 | A1 * | 4/2012 | Kida et al. | 162/139 |
| 2012/0231288 | A1 * | 9/2012 | Kida et al. | 428/537.5 |
| 2013/0011546 | A1 * | 1/2013 | Izumiya et al. | 427/8 |

FOREIGN PATENT DOCUMENTS

| | | | |
|---|---|---|---|
| JP | 2004-512849 | A | 4/2004 |
| JP | 2009-504174 | A | 2/2009 |
| JP | 2010-529306 | A | 8/2010 |
| WO | WO 02/37991 | A1 | 5/2002 |
| WO | WO 2007/020532 | A1 | 2/2007 |
| WO | WO 2008/146159 | A2 | 12/2008 |
| WO | WO 2009/022545 | A1 | 2/2009 |
| WO | WO 2009/099011 | A1 | 8/2009 |

* cited by examiner

*Primary Examiner* — Mark Halpern
(74) *Attorney, Agent, or Firm* — Birch, Stewart, Kolasch & Birch, LLP

(57) ABSTRACT

The present invention provides a machine for manufacturing low ignition propensity wrapping paper for cigarettes having combustion inhibition bands (B) intermittently formed on a web of paper by applying a combustion inhibition agent solution to the web by transfer. The machine includes a gravure roll (34) for forming combustion inhibition bands (B) on a web, the gravure roll (34) having recesses (66) in an outer circumferential surface for receiving the combustion inhibition agent solution, the recesses (66) each having a contour corresponding to the contour of the to-be-formed combustion inhibition band and having a large number of lands (68; 70) distributed therein and constituting parts of the outer circumferential surface of the gravure roll, and the recesses each being designed such that the total area of the lands within the recess is smaller than the area of the recess excluding the lands.

11 Claims, 7 Drawing Sheets

LOW IGNITION PROPENSITY WRAPPING PAPER MANUFACTURING MACHINE

This application is a Continuation of PCT International Application No. PCT/JP2011/069181 filed on Aug. 25, 2011, which claims priority under 35 U.S.C 119(a) to Application No. PCT/JP2010/066926 filed in Japan on Sep. 29, 2010, all of which are hereby expressly incorporated by reference into the present application.

TECHNICAL FIELD

The present invention relates to a machine for manufacturing low ignition propensity wrapping paper which imparts a low ignition propensity to cigarettes, low ignition propensity wrapping paper manufactured with the machine, and cigarettes manufactured using the low ignition propensity wrapping paper.

BACKGROUND ART

Low ignition propensity wrapping paper for cigarettes has become known in recent years. This wrapping paper has applications of a combustion inhibition agent in predetermined regions.

Specifically, low ignition propensity wrapping papers disclosed in patent documents 1 and 2 comprise a web of paper and combustion inhibition bands on the web spaced from one another by a predetermined distance along the length of the web. The combustion inhibition bands are formed by applying a solution of a combustion inhibition agent to the web. The web with the combustion inhibition agent solution applied is then dried with a dryer, so that low ignition propensity wrapping paper is completed.

In recent years, in countries including the USA, regulations concerning low ignition propensity cigarettes have come into effect. In the USA, for example, cigarettes are required to meet the standard for full-length burn ratio (FLB ratio), where the full-length burn ratio is measured and calculated in accordance with the ASTM (American Society for Testing and Materials) standard E2187-04. Cigarettes meeting the FLB ratio standard (low ignition propensity cigarettes) include a paper wrapper with bands formed by applying a combustion inhibition agent, spaced from one another along the axis of the cigarette.

In forming such combustion inhibition bands, or in other words, applying a combustion inhibition agent solution to the web, a gravure roll is used as disclosed in patent documents 1 and 2. The gravure roll has transfer regions on an outer circumferential surface thereof, corresponding to to-be-formed combustion inhibition bands. The transfer regions are equally spaced from one another along the circumference of the gravure roll.

Specifically, the transfer regions each include a large number of recesses called cells, the cells being uniformly distributed in each transfer region. The cells in each transfer region hold a combustion inhibition agent solution. Combustion inhibition bands are formed on the web by transfer of the combustion inhibition agent solution from the cells to the web.

PRIOR ART DOCUMENT

Patent Document

Patent Document 1: JP 2004-512849 A
Patent Document 2: JP 2009-504174 A

SUMMARY OF THE INVENTION

Problems to be Solved by the Invention

The ratio of the total area of the cells in a transfer region to the area of the transfer region, which will be referred to as "cell area ratio", is only about 60% at the most, and the cells are independent from one another because of banks. This prevents the combustion inhibition agent solution transferred from the individual cells to the web from uniformly spreading over a region intended for a combustion inhibition band.

As a result, the combustion inhibition band formed includes portions lacking an application of the combustion inhibition agent solution, which will be referred to as "lack portions". In addition, the portions with the combustion inhibition agent solution applied exhibit variations in application thickness. Such lack portions and variations in application thickness result in variations in quality of the combustion inhibition bands, leading to degraded performance of low ignition propency wrapping paper and great variations in full-length burn ratio (FLB ratio) of cigarettes.

To remove variability of quality of combustion inhibition bands, it is conceivable to form the cells with an increased depth so that the cells can hold an increased amount of the combustion inhibition agent solution. The solution of the combustion inhibition agent has, however, a relatively high concentration, and thus, a relatively high viscosity and exhibits a relatively low flowability. Since such combustion inhibition agent solution can not efficiently be discharged from the individual cells, an increase in the amount the combustion inhibition agent solution held in the respective cells does not lead to removal of the quality variability.

In the inventions disclosed in patent documents 1 and 2, a combustion inhibition agent solution having a relatively low concentration or a relatively low viscosity is applied using a plurality of applicators. In other words, the inventions disclosed in patent documents 1 and 2 intend to restrict the quality variations of combustion inhibition bands by repeating application of the combustion inhibition agent solution to the web. However, machines of patent documents 1 and 2, which need a plurality of applicators as mentioned above, are inevitably large-scale. In addition, it is not easy to apply the combustion inhibition agent solution exactly in the same regions of the web over again.

Further, as seen from patent document 1, the web needs to be subjected to drying after each application of the combustion inhibition agent solution. This requires increased power of drying the web, and the increased drying power is likely to cause wrinkling of the web or the low ignition propensity wrapping paper. Use of such wrinkled low ignition propensity wrapping paper degrades the appearance of cigarettes.

A first object of the present invention is to provide a machine which has a simple structure and which can reliably manufacture low ignition propensity wrapping paper with combustion inhibition bands exhibiting restricted quality variations. A second object of the present invention is to provide low ignition propensity wrapping paper manufactured with the machine of the present invention, and cigarettes manufactured using the low ignition propensity wrapping paper of the present invention.

Means for Solving the Problems

The first object is achieved by a machine of the present invention, which comprises an applicator arranged along a web traveling path to periodically apply a combustion inhibition agent solution to a web of paper traveling along the web traveling path, by transfer, thereby forming combustion inhibition bands on the web spaced from one another along the length of the web and extending across the width of the web, and a dryer arranged along the web traveling path, downstream of the applicator, to dry the web with the combustion inhibition agent solution applied, thereby completing low ignition propensity wrapping paper, wherein the applicator includes a gravure roll for transferring the combustion inhibition agent solution to the web, the gravure roll having a large number of recesses in an outer circumferential surface thereof, spaced from one another along the circumference of the gravure roll, for receiving the combustion inhibition agent solution, the recesses each having a contour corresponding to the contour of to-be-formed combustion inhibition band and having a large number of lands distributed therein and constituting parts of the outer circumferential surface of the gravure roll, and the recesses each being designed such that total area of the lands within the recess is smaller than area of the recess excluding the lands.

Specifically, the recesses may each be designed such that the lands provide, within the recess, a large number of grooves running at least widthwise with respect to the gravure roll, where the area of the recess excluding the lands is desirably 75% or greater, particularly 90% or greater of the area of the to-be-formed combustion inhibition band.

In the above-described machine, the recesses are each designed such that the area of the recess excluding the lands, which directly serves to transfer the combustion inhibition agent solution, is greater than the total area of the lands, and that the lands provide, within the recess, a plurality of grooves running at least widthwise with respect to the gravure roll. Supply of the combustion inhibition agent solution to such recesses is easy, as compared with the aforementioned conventional cells, even when the combustion inhibition agent solution has a low flowability, and thus, the combustion inhibition agent solution is reliably supplied to the recesses.

Discharge of the combustion inhibition agent solution from such recesses is also easy, and thus, the combustion inhibition agent solution is satisfactorily transferred to the web, resulting in effectively-restricted quality variations of the combustion inhibition bands.

This machine allows the use of a combustion inhibition agent solution having a low flowability, which means that the combustion inhibition agent solution is allowed to be used at an increased concentration. The drying of the combustion inhibition bands formed by applying the high-concentration combustion inhibition agent solution does not require high power of drying, and thus, wrinkling of the web caused by drying is reliably prevented.

Specifically, the recesses may each be designed such that the lands are islands distributed in the recess to provide grooves forming a lattice pattern within the recess. The lattice pattern formed by the grooves may be at an angle to the axis of the gravure roll.

The applicator may include a doctor blade for removing an excess of the combustion inhibition agent solution from the outer circumferential surface of the gravure roll, where the doctor blade has a distal end desirably directed in the direction of rotation of the gravure roll. The doctor blade is desirably arranged with the distal end located above the center of the gravure roll.

The recesses may each be designed such that the lands are oblique banks distributed in the recess, spaced from one another along the circumference of the gravure roll and extending at an angle to the axis of the gravure roll to provide a large number of oblique grooves within the recess, where the oblique banks desirably extend at an angle of 45° or less to the axis of the gravure roll.

The present invention also provides low ignition propensity wrapping paper manufactured with the above-described machine, and cigarettes manufactured using the low ignition propensity wrapping paper.

Advantageous Effects of the Invention

The machine of the present invention can not only restrict quality variations of the combustion inhibition bands but also prevent wrinkling of the web or the low ignition propensity wrapping paper. The machine thus enables manufacture of the low ignition propensity wrapping paper exhibiting required performance, and manufacture of cigarettes using the wrapping paper.

Further objects and advantages of the present invention will become clear from an embodiment of the present invention described below with reference to the drawings attached.

MODE FOR CARRYING OUT THE INVENTION

Figure 1:
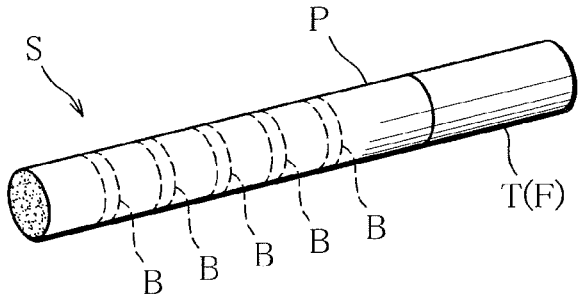
FIG. 1 is a perspective view showing a low ignition propensity filtered cigarette.

A low ignition propensity filtered cigarette shown in FIG. 1 comprises a cigarette S and a filter F attached to an end of the cigarette S. The filter F is connected to the cigarette S by tip paper T. The cigarette S includes smokable materials having shredded tobacco and a paper wrapper P surrounding the smokable materials. The paper wrapper P has a low ignition propensity.

Figure 2:
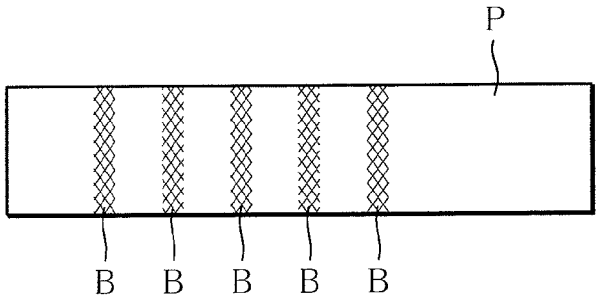
FIG. 2 shows a paper wrapper constituting the cigarette of FIG. 1 in a spread-out state.

Specifically, as seen in FIG. 2, the paper wrapper P has a plurality of combustion inhibition bands B (hereinafter referred to simply as "bands"). Bands B are formed by applying a solution of a combustion inhibition agent to the paper P by transfer printing. Specifically, the bands B are spaced from one another along the length of the paper wrapper P (along the axis of the cigarette S) and each extend across the paper wrapper P or extirely around the circumference of the cigarette S.

Figure 3:
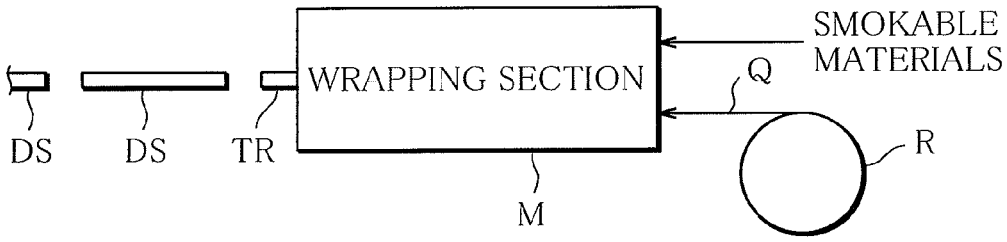
FIG. 3 is a cigarette manufacturing machine for manufacturing the cigarette of FIG. 1.

FIG. 3 schematically shows a cigarette manufacturing machine for manufacturing the cigarette S.

The cigarette manufacturing machine comprises a web roll R. Low ignition propensity wrapping paper Q, from which the paper wrapper P is obtained, is fed from the web roll R to a wrapping section M. Also the smokable materials including shredded tobacco are supplied to the wrapping section M. In the wrapping section M, the smokable materials are wrapped in the wrapping paper Q to form a continuous tobacco rod TR.

Then in a cutting section (not shown), the tobacco rod TR is cut into predetermined lengths to form double cigarettes DS of twice the length of the cigarette S. The cutting section is located at downstream of the wrapping section M.

The resulting double cigarettes DS are then supplied to a machine called "filter attachment" (not shown). Supplied with double cigarettes DS and double filters, the filter attachment forms filtered cigarettes shown in FIG. 1 in the known way, where two filtered cigarettes are formed from one double cigarette DS and one double filter.

Figure 4:
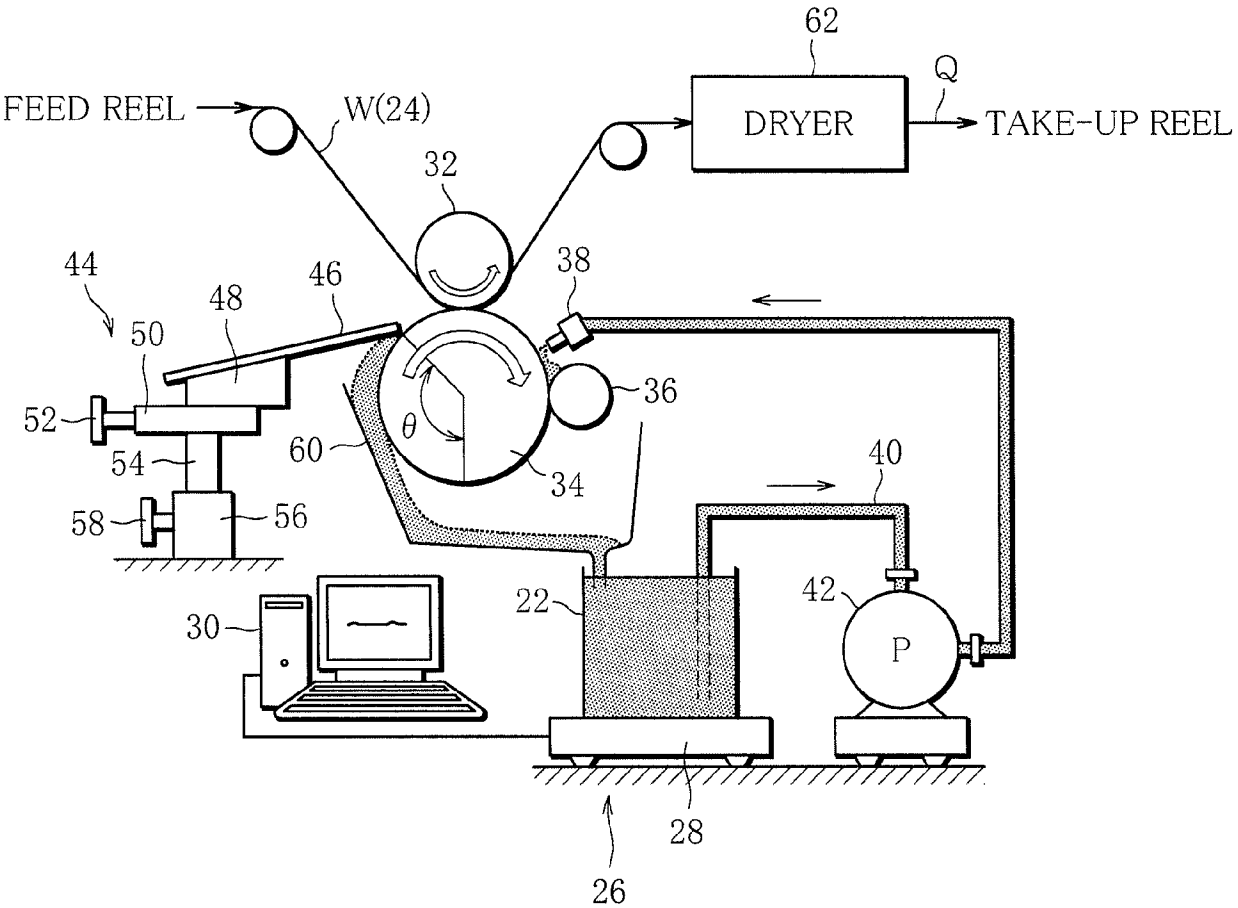
FIG. 4 is a machine for manufacturing low ignition propensity wrapping paper from which the paper wrapper of FIG. 2 is obtained.

FIG. 4 shows a wrapping paper manufacturing machine for manufacturing the low ignition propensity wrapping paper Q.

The wrapping paper manufacturing machine is provided with a web W traveling path 24. The traveling path 24 runs from a web W feed reel to a take-up reel. A web W of paper, fed from the feed reel and traveling along the traveling path 24, is wound onto the take-up reel to form an original roll. The aforementioned web roll R is obtained by cutting the original roll. If, however, the web W has the same width as the paper wrapper P, the original roll formed on the take-up reel is directly used as the web roll R.

An applicator 26 is arranged along the traveling path 24. The applicator 26 comprises a supply tank 22. The supply tank 22 holds a solution of a combustion inhibition agent. In the present embodiment, the supply tank 22 is placed on a weight scale 28. The weight scale 28 detects the weight of the supply tank 22 telling the amount of the combustion inhibition agent solution remaining in the supply tank, and transmits the detected value to a monitoring system 30. The monitoring system 30 includes a display and can present on the display how much combustion inhibition agent solution remains in the supply tank 22 and/or how much combustion inhibition agent solution has been consumed, calculated from the detected weight.

The combustion inhibition agent solution can be prepared by dissolving a powder-form combustion inhibition agent in soft water. The combustion inhibition agent may be sodium alginate or pectin. The soft water used to prepare the solution contains practically no mineral ions such as calcium ions ($Ca^{2+}$) or magnesium ions ($Ma^{2+}$). Desirably, the mineral ion concentration of the soft water is 0 to 1 mg/l. In place of soft water, pure water may be used to prepare the combustion inhibition agent solution.

In the present embodiment, the concentration of the combustion inhibition agent (pectin) solution is 3%, and the combustion inhibition agent solution exhibits a viscosity of 1200 cP at 20° C.

The applicator 26 further comprises a press roll and a gravure roll 34. The press roll 32 and the gravure roll 34 are arranged to face each other with the traveling path 24, and thus, the web W between, and rotatable in opposite directions. The gravure roll 34 has a large number of transfer regions on the outer circumferential surface thereof, designed to hold the combustion inhibition agent solution. To form bands B on the web W periodically, the transfer regions are spaced from one another by a predetermined distance along the circumference of the gravure roll 34. The transfer regions will be described later.

A furnisher roll 36 is arranged rotatably in contact with the outer circumferential surface of the gravure roll 34. A nozzle 38 is arranged above the furnisher roll 36. The nozzle 38 is connected to the supply tank 22 by supply piping 40, and the supply piping 40 is equipped with a displacement pump 42. Thus, while the pump 42 is being driven, the combustion inhibition agent solution is forced by the pump 42 from the supply tank 22 to the nozzle 38 through the supply piping 40, and supplied onto the outer circumferential surface of the gravure roll 34, between the gravure roll 34 and the furnisher roll 36, by means of the nozzle 38.

A remover 44 is arranged near the gravure roll 34 to remove an excess of the combustion inhibition agent solution from the outer circumferential surface of the gravure roll 34. The remover 44 includes a doctor blade 46. The doctor blade 46 has a distal end in sliding contact with the outer circumferential surface of the gravure roll 34.

Specifically, as seen in FIG. 4, the distal end of the doctor blade 46 is located on the outer circumferential surface of the gravure roll 34, in a zone from the furnisher roll 36 to the press roll 32, as viewed in the direction of rotation of the gravure roll 34, and directed to the press roll 32. The distal end of the doctor blade 46 is located above the center of the gravure roll 34. Specifically, the distal end of the doctor blade 46 is positioned such that the angle θ between a vertical line extending from the center of the gravure roll 34 downward and a line connecting the distal end of the doctor blade 46 and the center of the gravure roll 34 is 135°, for example.

The doctor blade 46 is fitted to a slider 48. The slider 48 is mounted on a support table 50 and capable of being moved nearer to or farther away from the gravure roll 34 by manipulating a handle 52. From the support table 50, a shaft 54 extends downward. The lower end of the shaft 54 is supported in a base 56. Through the shaft 54, the support table 50 is capable of being moved up and down relative to the base 56 by manipulating a handle 58. The position at which the distal end of the doctor blade 46 contacts the outer circumferential surface of the gravure roll 34 is thus adjustable by moving the slider 48 and moving the support table 50 up and down.

The remover 44 also includes a recovery chute 60. The recovery chute 60 is arranged under the doctor blade 46, the gravure roll 34 and the furnisher roll 36 to cover a distal end-side part of the doctor blade, a lower part of the gravure roll and a lower part of the furnisher roll, and connected to the supply tank 22.

Further, a dryer 62 is arranged along the traveling path 24, downstream of the press roll 32 and the gravure roll 34. By passing through the dryer 62, the web W is dried with the dryer 62.

Figure 5:
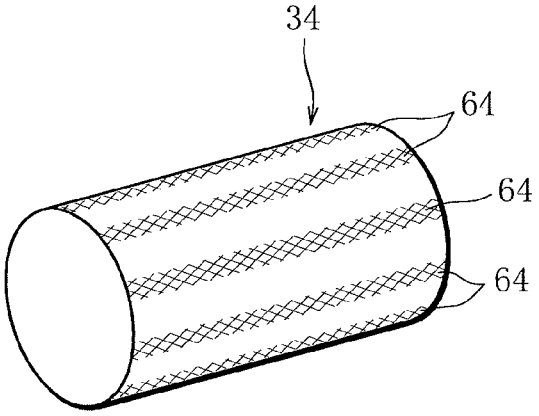
FIG. 5 is a perspective view schematically showing a gravure roll shown in FIG. 4.

As seen in FIG. 5, the gravure roll 34 has a large number of transfer regions 64 on the outer circumferential surface. The transfer regions 64 each have a contour corresponding to the contour of the to-be-formed band B. The transfer regions 64 are equally spaced from one another along the circumference of the gravure roll 34. Specifically, in one embodiment, the transfer regions 64 are each formed by a recess 66 with a large number of lands distributed therein, intended to receive the combustion inhibition agent solution, where the recess 66 determines the contour of the transfer region 64, the lands constitute parts of the outer circumferential surface of the gravure roll 34, and the total area of the lands is smaller than the area of the recess 66 excluding the lands.

Within the recess 66, the lands provide grooves running at least widthwise with respect to the gravure roll 34. In the present embodiment, the lands are islands 68, and the area of the recess 66 excluding the lands, which will be referred to as "remaining area of the recess 66", accounts for 75% or greater, desirably 90% or greater of the area of the transfer region 64 (area of the band B).

Figure 6:
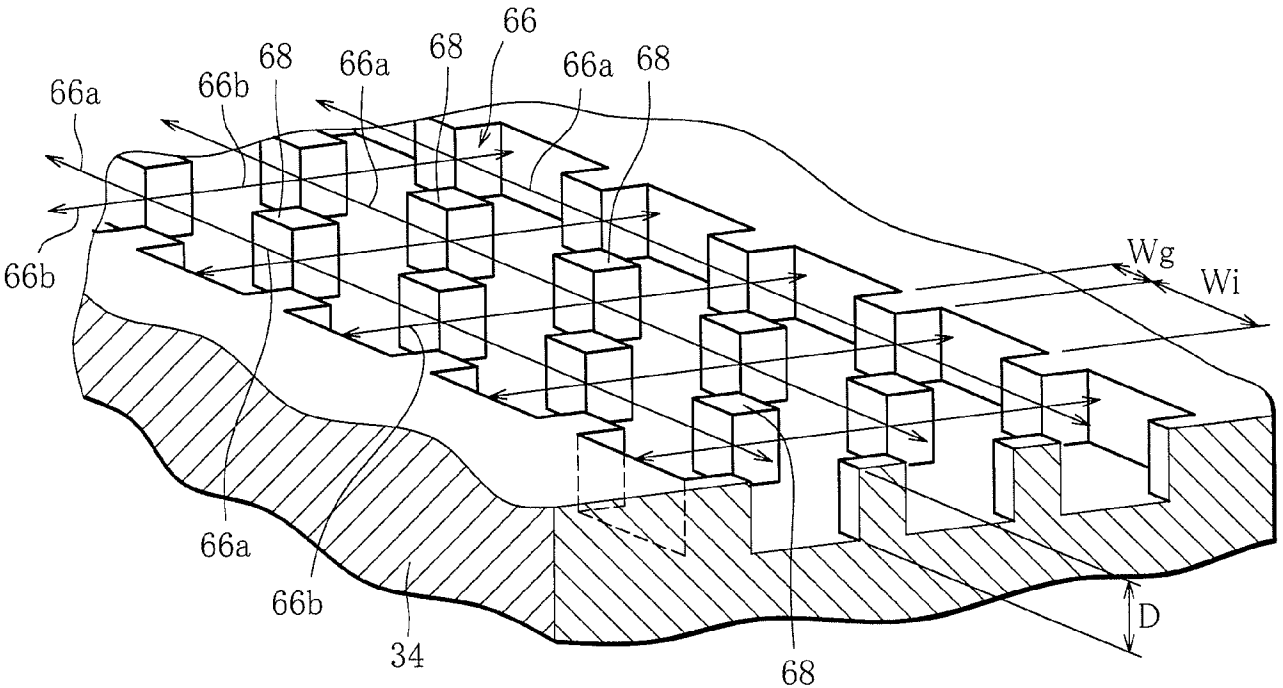
FIG. 6 is an enlarged perspective view schematically showing part of the outer circumferential surface of an embodiment of the gravure roll.

Within the recess 66, the islands 68 provide grooves forming an oblique lattice pattern. Specifically, as seen in FIG. 6, a large number of parallel grooves 66*a* running at an angle to a transverse section of the gravure roll 34 and spaced from one another along the width of the gravure roll 34, and a large number of parallel grooves 66*b* crossing at right angles to the grooves 66*a* and spaced from one another along the width of the gravure roll 34 form an oblique lattice pattern. Each island 68 is thus surrounded by two adjacent grooves 66*a* and two adjacent grooves 66*b*.

In the present embodiment, the grooves 66*a*, 66*b* have the same width Wg, and the islands 68 are in a square shape of width Wi, or in other words, length Wi on a side. Specifically, widths Wg and Wi are 500 μm and 100 μm, respectively. In this case, the remaining area of the recess 66 accounts for 94.7% of the area of the transfer region 64 (band B). In other words, the ratio of the remaining area of the recess 66 (total area of the grooves 66*a*, 66*b*) to the area of the transfer region 64 is 94.7%.

If widths Wg and Wi are 400 μm and 200 μm, respectively, the ratio of the remaining area of the recess 66 is 75%. In each case, the depth D of the grooves 66*a*, 66*b* is 50 μm.

Figure 7:
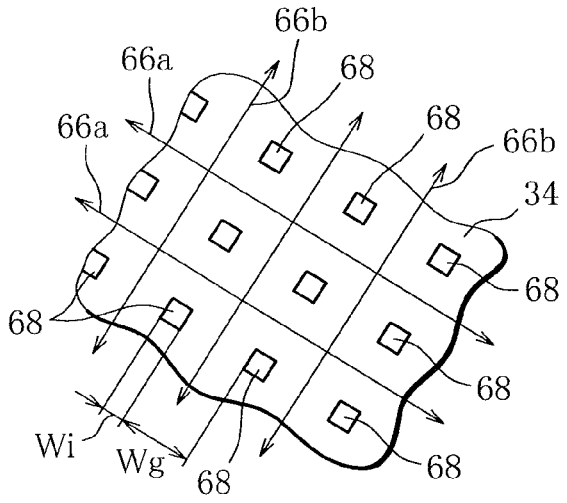
FIG. 7 shows grooves and islands shown in FIG. 6, in a size ratio close to a real one.

In FIG. 6, for reasons related to drawing the figure, width Wg is exaggerated as compared with width Wi. Actually, as seen from FIG. 7, the individual islands 68 are sufficiently small in width as compared with the grooves 66*a*, 66*b*.

In the above-described applicator 26, as the gravure roll 34 rotates so that the transfer regions 64 on the outer circumferential surface pass over the furnisher roll 36 one after another, the combustion inhibition agent solution is supplied into the recess 66 of each transfer region 64 so that the surface of each transfer region (including the islands 68) is wet with the combustion inhibition agent solution.

As described above, the recess 66 is designed such that the remaining area of the recess 66 accounts for 75% or greater, desirably 90% or greater of the area of the transfer region 64, and that the recess 66 comprises the crossing grooves 66*a*, 66*b*. Such recess 66 is capable of easily taking in the combustion inhibition agent solution. This means that even a combustion inhibition agent solution has a low flowability or a high concentration, the combustion inhibition agent solution is reliably supplied into the recess 66.

Use of higher concentration of the combustion inhibition agent solution allows a reduction in the amount of the combustion inhibition agent solution applied to form the band B, and thus, allows the recess 66 to have smaller depth D, leading to easier creation of the transfer regions 64 on the outer circumferential surface of the gravure roll 34.

After supplied with the combustion inhibition agent solution, each transfer region 64 passes under the doctor blade 46, where an excess of the combustion inhibition agent solution is scraped from the outer circumferential surface (including the islands 68) of the gravure roll 34 by the doctor blade 46.

As stated above, the doctor blade 46 is arranged with its distal end, or blade edge directed in the direction of rotation of the gravure roll 34, and thus, toward the press roll 32. This prevents the blade edge of the doctor blade 46 from scratching an edge of an island 68 in the recess 66. In addition, as stated above, the recess 66 includes grooves forming an oblique lattice pattern, which means that the four edges of each island 68, namely four sides of the square shape of each island are to cross the blade edge of the doctor blade 46.

Thus, with a recess 66, or transfer region 64 passing under the doctor blade 46, the edges of those islands 68 which are just starting to pass under the blade edge of the doctor blade 46 do not make a line contact but make a point contact with the blade edge of the doctor blade 46. Such contact does not cause a bound of the blade edge of the doctor blade 46. The doctor blade 48 is therefore allowed to stably perform its scraping function.

In addition, the doctor blade 46 is arranged with its blade edge located above the center of the gravure roll 34. This allows the doctor blade 46 to push the portion of the combustion inhibition agent solution scraped from the outer circumferential surface (including the islands 68) of the gravure roll 34 into the recess 66, leading to increased reliability of supply of the combustion inhibition agent solution into the recess 66.

Each transfer region 64 then passes under the press roll 32, where the combustion inhibition agent solution is transferred from the recess 66 to the web W, or in other words, applied to the web W passing between the press roll 32 and the gravure roll 34. As a result, bands B are formed on the web W in a manner corresponding to the transfer regions 64.

The islands 68 distributed in the recess 66 help the surface of the combustion inhibition agent solution in the recess 66 to make a good surface contact with the web W, and in addition, ease the discharge of the combustion inhibition agent solution from the recess 66, or grooves 66*a*, 66*b*. As a result, the combustion inhibition agent solution is satisfactorily transferred from the recess 66 to the web W and spreads also over those portions of the web W which correspond to the islands 68, resulting in a uniform application of the combustion inhibition agent solution over the entire band B in spite of the presence of the islands 68.

The band B formed by the transfer region 64 therefore includes practically no portions lacking an application of the combustion inhibition agent solution, and exhibits a practically uniform thickness in every part, and thus, effectively-restricted quality variations.

The web W with the bands B formed then passes through the drier 62, where the bands B, or combustion inhibition agent solution on the web W is dried with the dryer 62. In, the present embodiment which allows use of the combustion inhibition agent solution at high concentration, the dryer 62 does not need to have high power of drying, and the web W does not need to be subjected to drying more than once. The drying therefore does not cause wrinkling of the web W.

The web W dried, or in other words, completed low ignition propensity wrapping paper Q is wound on the take-up reel to form the original roll. The low ignition propensity wrapping paper Q with the bands B having restricted quality variations reliably results in cigarettes satisfying the requirement on the full-length burn ratio (FLB ratio: 25% or less) in the test according to the ASTM standard. Further, the low ignition propensity wrapping paper Q, which is not wrinkled, provides good appearance of cigarettes.

In the test according to the ASTM standard, cigarettes ignited at an end (ignition position) are left to burn spontaneously in air until their combustion end reaches a line 15 mm away from the ignition position. The cigarettes are then placed on filter paper, by which the test on the cigarettes starts. The test is conducted on a predetermined number of cigarettes, where the full-length burn ratio (FLB ratio) means a ratio of those cigarettes which exhibit full-length burns to all the cigarettes tested.

With regard to low ignition propensity cigarettes manufactured with the low ignition propensity wrapping paper Q, table 1 below shows how the full-length burn ratio (FLB ratio) and the quality variation of bands B are related to the remaining area ratio, namely ratio of the area of the recess 66 excluding the islands 68 to the area of the transfer region 64 (band B), where the amount of the combustion inhibition agent solution applied to form each band B of the low ignition propensity wrapping paper Q is the same in spite of the varying remaining area ratios.

TABLE 1

| Remaining area ratio | FLB ratio (%) Avarage | Variation (σ) |
|---|---|---|
| 90% or greater | 0 | 0 |
| 75% to 89% | 20 | 14 |
| 74% or less | 56 | 25 |

As seen from table 1, the remaining area ratio of 75% or greater results in reduced variations. The remaining area ratio of 90% or greater results in 0 variation (σ). As stated above, the recess 66 (grooves 66*a*, 66*b*) in the transfer region 64 is designed to easily take in and discharge the combustion inhibition agent solution, so that the band B formed by the transfer region 64 exhibits restricted quality variations.

The present embodiment allows use of the combustion inhibition agent solution at increased concentration, and thus, allows a reduction in the amount of the combustion inhibition agent solution applied to form the band B.

As mentioned above, the combustion inhibition agent solution contains practically no mineral ions, such as calcium ions or magnesium ions, leading to effectively-restricted gelatinization of the combustion inhibition agent solution caused by cross-linking reaction between the mineral ions and the combustion inhibition agent.

In addition, the excess of the combustion inhibition agent solution scraped from the outer circumferential surface of the gravure roll 34 by the doctor blade 46 is returned to the supply tank 22 through the recovery chute 60 and fed from the supply tank 22 to the nozzle 38. This means that while the wrapping paper manufacturing machine is operating, the combustion inhibition agent solution is circulating between the gravure roll 34 and the supply tank 22, and thus, always flowing, which also restricts gelatinization of the combustion inhibition agent solution.

The combustion inhibition agent solution thus does not experience an increase in viscosity in the supply tank 22; it is maintained at low viscosity. This allows easy handling of the combustion inhibition agent solution as well as easy application thereof to the web W.

The present invention is not limited to the above-described embodiment, which can be altered in various ways.

For example, the islands 68 in the recess 66 may provide, within the recess 66, grooves 66*a* parallel to the axis of the gravure roll 34 and grooves 66*b* crossing such grooves 66*a* to form a lattice pattern, in place of the aforementioned grooves 66*a*, 66*b* forming an oblique lattice pattern.

Figure 8:
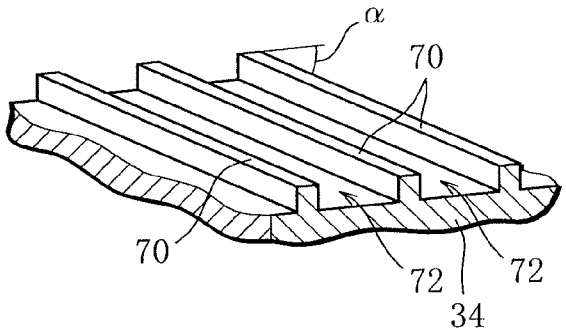
FIG. 8 is a perspective view schematically showing part of the outer circumferential surface of a variant of the gravure roll.
Figure 9:
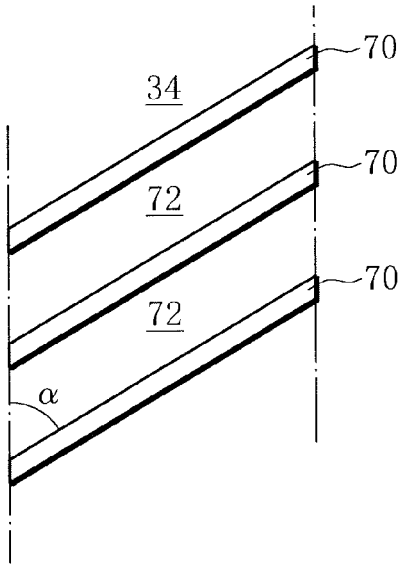
FIG. 9 is a plan view of the outer circumferential surface shown in FIG. 8.

Further, as seen in FIGS. 8 and 9, the recesses 66 in the gravure roll 34 may each have a large number of oblique banks 70 in place of the islands 68, where the oblique banks 70 are spaced from one another along the circumference of the gravure roll 34 and extend at an angle α to the axis of the gravure roll 34. Such oblique banks 70 provide a large number of oblique grooves 72 within the recess 66, in place of the grooves 66*a*, 66*b*.

Specifically, the angle α is limited to 45°. It is typically 20 to 45°, and desirably, about 30°.

Needless to say, the total area of the oblique grooves 72 accounts for 75% or greater, desirably 90% or greater of the area of the transfer region 64. In other words, the ratio A:B of the remaining area A of the recess 66 to the total area B of the oblique banks 70 is 4:1 to 50:1, desirably about 5:1 to 10:1. The oblique banks 70 have desirably a depth greater than the depth D of the aforementioned grooves 66*a*, 66*b*.

With respect to receiving and transferring the combustion inhibition agent solution, the oblique grooves 72 have an advantage similar to that the combined grooves 66*a*, 66*b* have. As compared with the combined grooves 66*a*, 66*b*, however, the oblique grooves 72 are suited for transfer of a combustion inhibition agent solution of medium viscosity (500 CP to 3000 CP), since the combustion inhibition agent solution of medium viscosity is capable of quickly filling the oblique grooves 72 over their entire length, and being transferred from the oblique grooves 72 to the web W with a sufficiently-high efficiency.

The angle α of the oblique banks 70 is limited to 45°. The oblique grooves 72 resulting from such oblique banks are capable of easily receiving and discharging the combustion inhibition agent solution, and thus, capable of forming a band B having restricted quality variations, as in the described embodiment.

The combustion ignition agent solution may be a solution of a combustion ignition agent other than sodium alginate or pectin. In the configuration shown in FIG. 3, the applicator 26 and the dryer 62 may be arranged between the web roll R set in the cigarette manufacturing machine and the wrapping section M.

EXPLANATION OF REFERENCE SIGNS

24 Traveling path
26 Applicator
32 Press roll
34 Gravure roll
36 Furnisher roll
38 Nozzle
44 Remover
46 Doctor blade
62 Dryer
64 Transfer region
66 Recess
66*a*, 66*b* Groove
68 Island (land)
70 Oblique bank (land)
72 Oblique groove
B Combustion inhibition band
P Paper wrapper (lowered ignition propensity paper wrapper)
Q Wrapping paper
S Cigarette
W Web

The invention claimed is:

1. A low ignition propensity wrapping paper manufacturing machine, comprising:

an applicator arranged along a web traveling path to periodically apply a combustion inhibition agent solution to a web of paper traveling along the web traveling path, by transfer, thereby forming combustion inhibition bands on the web spaced from one another along the length of the web and extending across the width of the web, and a dryer arranged along the web traveling path, downstream of said applicator, to dry the web with the combustion inhibition agent solution applied, thereby completing low ignition propensity wrapping paper, wherein said applicator includes a gravure roll for transferring the combustion inhibition agent solution to the web, the gravure roll having a large number of recesses in an outer circumferential surface thereof, spaced from one another along circumference of the gravure roll, for receiving the combustion inhibition agent solution, the recesses each having a contour corresponding to the contour of a to-be-formed combustion inhibition band, and large number of lands distributed in the recesses, respectively, and constituting parts of an outer circumferential surface of the gravure roll, wherein the recesses each being designed such that total area of the lands within the recess is smaller than area of the recess excluding the lands.

2. The low ignition propensity wrapping paper manufacturing machine according to claim 1, wherein the recesses are each designed such that the lands provide, within the recess, a large number of grooves running at least widthwise with respect to the gravure roll.

3. The low ignition propensity wrapping paper manufacturing machine according to claim 2, wherein the recesses are each designed such that the area of the recess excluding the lands is 75% or greater of area of the to-be-formed combustion inhibition band.

4. The low ignition propensity wrapping paper manufacturing machine according to claim 3, wherein the recesses are each designed such that the lands are islands distributed in the recess to provide grooves forming a lattice pattern within the recess.

5. The low ignition propensity wrapping paper manufacturing machine according to claim 4, wherein the lattice pattern formed by the grooves is at an angle to the axis of the gravure roll.

6. The low ignition propensity wrapping paper manufacturing machine according to claim 3, wherein the recesses are each designed such that the lands are oblique banks distributed in the recess, spaced from one another along circumference of the gravure roll and extending at an angle to an axis of the gravure roll to provide a large number of oblique grooves within the recess.

7. The low ignition propensity wrapping paper manufacturing machine according to claim 6, wherein the oblique banks extend at an angle of 45° or less to the axis of the gravure roll.

8. The low ignition propensity wrapping paper manufacturing machine according to claim 2, wherein the recesses are each designed such that the area of the recess excluding the lands is 90% or greater of area of the to-be-formed combustion inhibition band.

9. The low ignition propensity wrapping paper manufacturing machine according to claim 2, further comprising a doctor blade for removing an excess of the combustion inhibition agent solution from the outer circumferential surface of the gravure roll, said doctor blade including a distal end directed in a direction of rotation of the gravure roll.

10. The lowered ignition propensity wrapping paper manufacturing machine according to claim 9, wherein the doctor blade is arranged with the distal end located above the center of the gravure roll.

11. The low ignition propensity wrapping paper manufacturing machine according to claim 1, wherein said lands are arranged on bottoms of the recesses.

* * * * *